US007013103B2

(12) United States Patent
Bae

(10) Patent No.: US 7,013,103 B2
(45) Date of Patent: Mar. 14, 2006

(54) DEVELOPER-SUPPLYING SYSTEM OF IMAGE FORMING APPARATUS

(75) Inventor: Hyun-wook Bae, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 19 days.

(21) Appl. No.: 10/629,719

(22) Filed: Jul. 30, 2003

(65) Prior Publication Data

US 2004/0096246 A1 May 20, 2004

(30) Foreign Application Priority Data

Nov. 19, 2002 (KR) ..... 10-2002-0071903

(51) Int. Cl.
*G03G 15/08* (2006.01)

(52) U.S. Cl. ..... 399/283; 399/281

(58) Field of Classification Search ..... 399/53, 399/55, 98, 99, 228, 234, 235, 279, 281, 399/283, 284, 285

See application file for complete search history.

(56) References Cited

U.S. PATENT DOCUMENTS 6,343,201 B1 * 1/2002 Wada et al. ..... 399/281
6,353,720 B1 * 3/2002 Sakai et al. ..... 399/234

* cited by examiner

*Primary Examiner*—Hoang Ngo
(74) *Attorney, Agent, or Firm*—Staas & Halsey LLP

(57) ABSTRACT

A developer-supplying system of an image forming apparatus includes a developer-supplying roller supplying a developer onto a developing roller and removing residual developer which is not transferred onto a photosensitive body, but remains on the developing roller after developing, and a residual developer-withdrawing member disposed in a spaced-apart relation with and opposite to the developer-supplying roller to withdraw the residual developer removed from the developing roller by the developer-supplying roller and transferred onto the developer-supplying roller. The developer-supplying system can not only prevent developer-supplying efficiency and residual developer-withdrawal efficiency of the developer-supplying roller from being reduced, but also reduce stress to the developer to prevent the developer from deteriorating.

24 Claims, 2 Drawing Sheets

DEVELOPER-SUPPLYING SYSTEM OF IMAGE FORMING APPARATUS

CROSS-REFERENCE TO RELATED APPLICATIONS

This application claims the priority of Korean Patent Application No. 2002-71903, filed Nov. 19, 2002, in the Korean Intellectual Property Office, the disclosure of which is incorporated herein by reference.

BACKGROUND OF THE INVENTION

1. Field of the Invention

The present invention relates to an electrophotographic image forming apparatus such as a copier, a facsimile machine, a laser printer, etc., and more particularly, to a developer-supplying system of an image forming apparatus having a residual developer-withdrawing member to remove residual developer which is not transferred onto a photosensitive body, but remains on a developing roller to be removed therefrom by a developer-supplying roller and to be moved onto the developer-supplying roller after developing.

2. Description of the Related Art

Generally, a non-contact image forming apparatus using one component nonmagnetic developer, as shown in FIG. 1, includes a photosensitive body 1 in the form of a drum rotating at a predetermined speed and direction (arrow A), a charging unit 2 applying a high DC/AC voltage onto a surface of the photosensitive body 1 to electrify the photosensitive body 1 to a predetermined electric potential, a laser scanning unit (not shown) forming an electrostatic latent image having a relatively high electric potential as compared to the surface of the photosensitive body 1 by scanning a laser beam 3 onto the surface of the photosensitive body 1 to discharge some electric potential therefrom, and a developing unit 4 attaching a developer 8 to the electrostatic latent image formed on the scanned surface of the photosensitive body 1 to form a visible image. The conventional apparatus further includes a transfer unit 9 transferring the developer 8 in the form of the visible image formed on the surface of the photosensitive body 1 onto a sheet of paper 13, a fixing unit (not shown) fixing the developer 8 transferred onto the sheet of paper 13 by heat and pressure, and a paper-discharging unit (not shown) discharging the sheet of paper 13 to the outside.

The developing unit 4 is provided with a developer-storing part 17 storing the developer 8, and a developing roller 5 disposed to rotate in a direction (arrow B) opposite to the rotation direction of the photosensitive body 1 and spaced a predetermined gap d from the photosensitive body 1, and connected to a development bias power source 12 to apply a development bias voltage in which AC voltage and DC voltage are added together. The developing unit 4 further includes a developer-supplying roller 6 disposed to rotate in a same direction as the rotation direction of the developing roller 5 coming in contact with the developing roller 5, a developer layer regulating member 7 regulating a thickness of a developer layer formed on the developing roller 5, and an anti-leak member 15 disposed below the developing roller 5 to prevent the developer 8 from leaking out.

The operation of the conventional image forming apparatus constructed as above will be described.

First, while the photosensitive body 1, of which the surface is electrified in a predetermined, for example, negative (−) electric potential by the charging unit 2, is rotated in the direction of arrow A, i.e., clockwise, an electrostatic latent image having a relatively-positive (+) electric potential is formed on the surface of the photosensitive body 1 by emitting the laser beam 3 from the laser scanning unit onto the surface of the photosensitive body 1 according to an image signal.

On the other hand, the developer 8 having a predetermined, for example, negative (−) polarity is moved onto a surface of the developing roller 5 by the developer-supplying roller 6 rotating in the direction of arrow B, i.e., counterclockwise, and is then attached thereon by an electric potential difference between the developer-supplying roller 6 and the developing roller 5 to which the development bias voltage is applied by the development bias power source 12.

Subsequently, the developer 8 attached on the surface of the developing roller 5 is frictionally electrified, and at the same time, is made in a thin developer layer having a uniform thickness, by the developer layer regulating member 7 coming in linear pressure contact with the developing roller 5.

Next, as the developing roller 5 continues to rotate, the developer 8 is moved into a development region in which the photosensitive body 1 faces the developing roller 5, and is attached to the electrostatic latent image due to an electric force generated by an electric potential difference between the electrostatic latent image formed on the surface of the photosensitive body 1 and the development bias voltage applied on the developing roller 5, to thereby form a visible image.

As the photosensitive body 1 rotates, the developer 8 attached to the electrostatic latent image is transferred onto the sheet of paper 13 supplied between the photosensitive body 1 and a transfer roller of the transfer unit 9, by a high voltage having a polarity opposite to that of the developer 8, i.e., a positive (+) polarity which is applied to the transfer roller of the transfer unit 9 disposed below the photosensitive body 1.

Next, the photosensitive body 1 continuously rotates so that a cleaning blade 10 removes developer remnants 8' which remain on the surface of the photosensitive body 1, and after the developer 8 transferred to the sheet of paper 13 is fixed by the fixing unit, the sheet of paper 13 is discharged to the outside by the discharging unit.

However, according to the conventional image forming apparatus, during developing, the developer 8 is not moved and attached to the electrostatic latent image from a surface in a non-developing region of the developing roller 5, but instead remains thereon. Thus, when the developer 8 remains on the surface in the non-developing region of the developing roller 5, if the developing operation is repeated, the residual developer 8 is over-electrified, so that when a developer layer is regulated by the developer layer-regulating member 7, uneven electrical potential values occur, thereby resulting in a problem that development efficiency deteriorates and thereby a density of the resultant image is lowered.

To prevent this problem, the conventional image forming apparatus is constructed so that the developer-supplying roller 6 withdraws the residual developer 8 from the developing roller 5 after developing. However, since the developer-supplying roller 6 is usually formed of a foam elastic material such as urethane foam, silicon foam, or sponge, when the developer-supplying roller 6 repeats the operation of withdrawing the residual developer 8 from the developing roller 5 for a long time, minute vacant spaces or holes in a surface of the developer-supplying roller 6 are filled with the residual developer 8, so that elasticity of the developer-supplying roller 6 deteriorates and hardness thereof is increased.

Thus, when the elasticity of the developer-supplying roller 6 deteriorates and the hardness thereof is increased, the developer-supplying roller 6 presents a problem that developer-supplying efficiency to supply the developer 8 onto the developing roller 5 and residual developer-withdrawal efficiency to withdraw the residual developer from the developing roller 5 are not only lowered, but also stress to the developer 8 is increased to deteriorate the developer 8.

SUMMARY OF THE INVENTION

Accordingly, it is an aspect of the present invention to provide a developer-supplying system of an image forming apparatus having a residual developer-withdrawing member to withdraw residual developer removed from a developer transfer body, such as a developing roller, by a developer-supplying roller and transferred onto the developer-supplying roller, thereby preventing developer-supplying efficiency and residual developer-withdrawal efficiency of the developer-supplying roller from being lowered, and reducing stress to the developer to prevent the developer from deteriorating.

Additional aspects and/or advantages of the invention will be set forth in part in the description which follows and, in part, will be obvious from the description, or may be learned by practice of the invention.

The foregoing and/or other aspects may be achieved by providing a developer-supplying system for use in an image forming apparatus having a developer-storing part to store a developer, a photosensitive body to form a latent image, and a developer transfer body rotated to face the photosensitive body, to transfer the developer from the developer-storing part to the photosensitive body to form a visible image according to the latent image, including a developer-supplying member supplying the developer onto the developer transfer body and removing the residual developer which is not transferred onto the photosensitive body; and a residual developer-withdrawing member disposed in a spaced-apart relation with and opposite to the developer-supplying member to withdraw the residual developer removed from the developer transfer body by the developer-supplying member and transferred onto the developer-supplying member.

The residual developer-withdrawing member may include a roller part disposed in a spaced-apart relation with and opposite to the developer-supplying member; and a withdrawal-electric field generating part generating a residual developer-withdrawing electric field between the developer-supplying member and the roller part to transfer the residual developer onto the roller part.

The roller part may be a roller formed of rubber material such as urethane, silicon, etc., a sleeve formed of metal material such as stainless steel, aluminum, etc., or a roller formed of metal material such as stainless steel, aluminum, etc., and rotates in a same direction as the developer-supplying member.

The withdrawal-electric field generating part may include a ground to ground the roller part to form the residual developer-withdrawing electric field between the developer-supplying member and the roller part. The withdrawal-electric field generating part may further include a withdrawal-bias power source connected to the roller part to apply a withdrawal-bias voltage thereto, to form the residual developer-withdrawing electric field between the developer-supplying member and the roller part.

The developer-supplying system may further include a developer anti-incoming member preventing the developer from coming into a residual developer-withdrawing region of the developer-storing part in which the roller part of the residual developer-withdrawing member is disposed in a spaced-apart relation with the developer-supplying member; and a cleaning member disposed at the developer anti-incoming member to contact the roller part to withdraw the residual developer removed from the developer-supplying member and transferred onto the roller part, and sent to the developer storing part.

The developer anti-incoming member may include a partition disposed in the developer-storing part over the residual developer-withdrawing region to prevent the developer from coming into the residual developer-withdrawing region, and defining the residual developer-withdrawing region.

The cleaning member may include a blade formed of rubber material such as urethane, silicon etc., and is fixed at the partition to allow a top end thereof to come in contact with the roller part at an upper stream in the rotation direction thereof.

The developer transfer body may include a sleeve formed of nonmagnetic material such as aluminum, stainless steel, etc., or a roller formed of rubber material such as urethane, NBR, etc., and the developer-supplying member may include a roller formed of foam rubber material such as urethane, silicon, etc.

BRIEF DESCRIPTION OF THE DRAWINGS

These and/or other aspects and/or advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
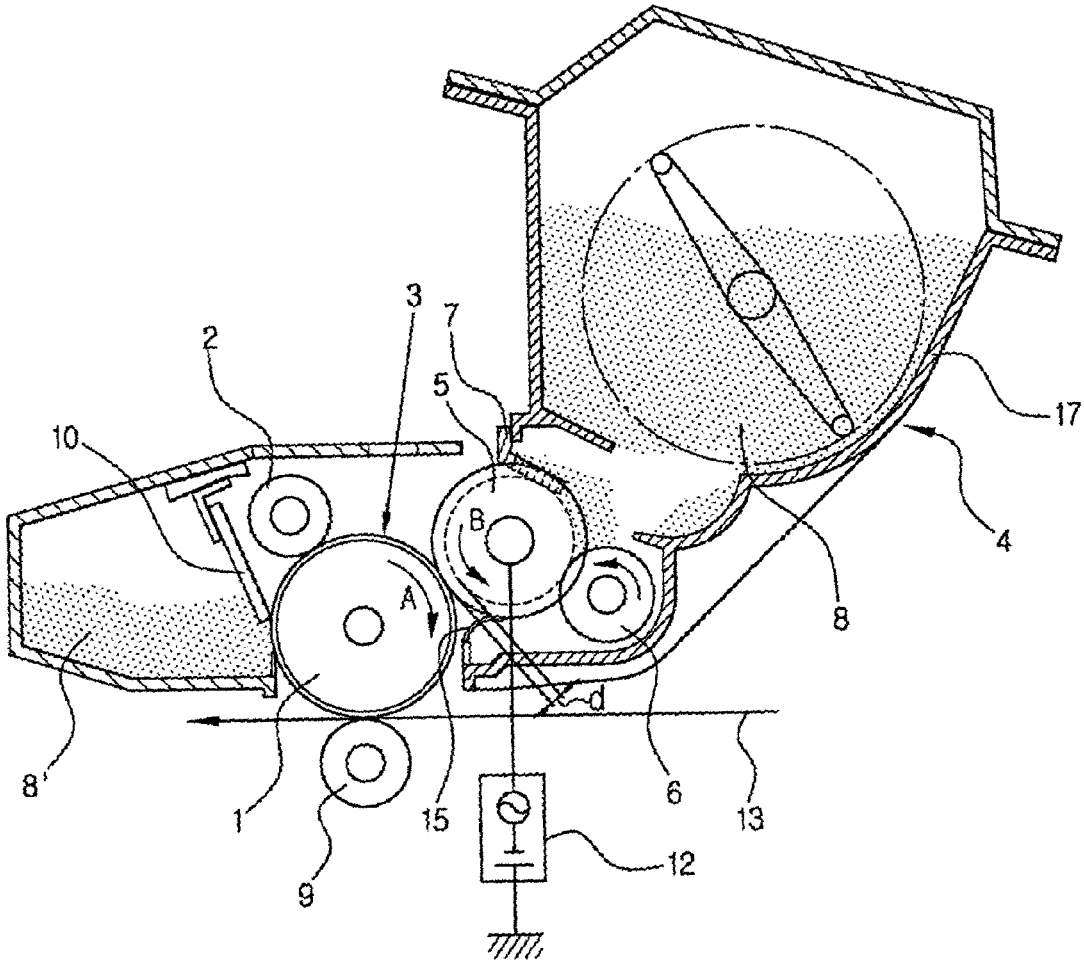
FIG. 1 (PRIOR ART)
FIG. 1 is a schematic view illustrating a general image forming apparatus.

Reference will now be made in detail to the present preferred embodiments of the present invention, examples of which are illustrated in the accompanying drawings, wherein like reference numerals refer to like elements throughout.

Figure 2:
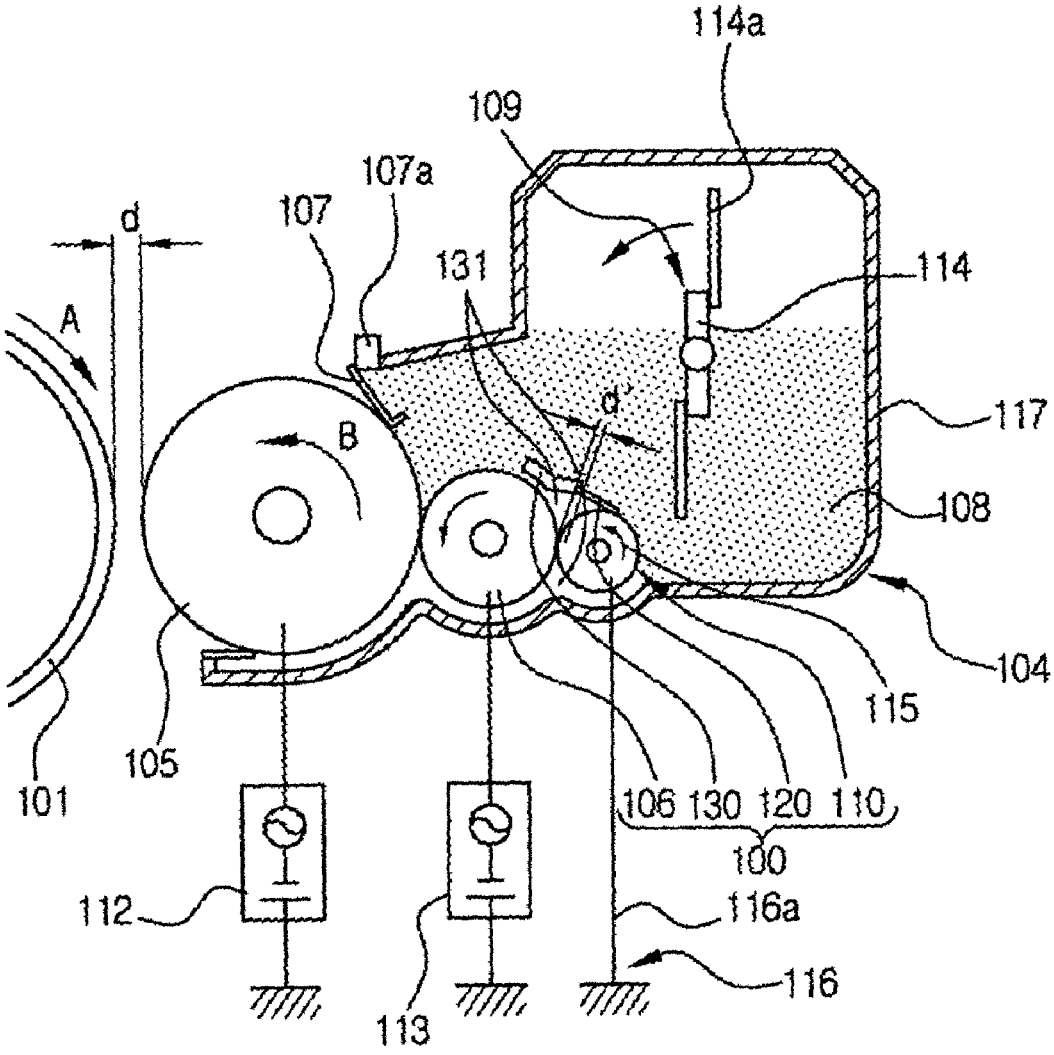
FIG. 2 is a partial view illustrating an image forming apparatus having a developer-supplying system in accordance with an embodiment of the present invention.

Referring now to FIG. 2, there is illustrated a developing unit 104 of an image forming apparatus to which a developer-supplying system 100 in accordance with an embodiment of the present invention is applied.

The developing unit 104 includes a developer-storing part 117 storing one component nonmagnetic developer 108 of a predetermined, for example, negative (−) polarity; a developing roller 105 disposed to rotate in a direction (arrow B) opposite to a rotation direction of a photosensitive body 101 in the form of a drum rotating at a predetermined speed and direction (arrow A), with a predetermined gap d between the photosensitive body 101, in order to attach the developer 108 to an electrostatic latent image formed on the photosensitive body 101 to form a visible image. The developing unit 104 further includes a developer layer-regulating member 107 regulating a thickness of a developer layer formed on the developing roller 105, and the developer-supplying system 100 supplying the developer 108 from the developer-storing part 117 to the developing roller 105.

The developer-storing part 117 includes a housing in which an agitator 109 is installed to rotate in a predetermined direction, for example, the direction of the developing roller (indicated by arrow B), to thereby agitate the developer 108.

On a wing 114 of the agitator 109, elastic seats 114*a* are mounted to come in contact with an inner surface of the housing when the wing 114 is rotated. Accordingly, the agitator 109 can supply new developer 108 toward a developer-supplying roller 106, and mix the developer 108 drawn into the developer-storing part 117 by a developer-cleaning member 120 (to be described later) with the new developer 108.

The developing roller 105 is formed of a sleeve member of nonmagnetic metal material such as stainless steel, aluminum, etc., of which a surface is machined by sand blasting to have an average roughness of 0.5–7 $\mu$m (JIS-B0610), or a roller of rubber material such as urethane, NBR, etc., having a thickness of 1–6 mm and a surface of average roughness of 0.5–7 $\mu$m.

The developing roller 105 rotates in a direction (arrow B) opposite to the rotation direction (arrow A) of the photosensitive body 101, i.e., counterclockwise.

Also, the developing roller 105 is connected to a development bias power source 112 to apply a development bias voltage V1 of a same polarity as the developer 108, i.e., negative (–) polarity thereto in developing. The development bias voltage V1 is a bias voltage in which DC voltage of –100 to –400V and AC voltage having a square wave with a frequency of 1–3 KHz and a peak-to-peak voltage of 1800 Vpp are piled up one on another.

Accordingly, in developing, the developer 108 attached on the developing roller 105 can be transferred and attached to the electrostatic latent image having a relatively positive (+) electric potential as compared to the negative (–) electric potential on the surface of the photosensitive body 101, by the development bias voltage V1 of negative (–) polarity applied to the developing roller 105.

The developer layer-regulating member 107, which is formed of a band-shaped elastic plate of metal material such as stainless steel, phosphor bronze, etc., having a thickness of about 0.1 mm, is fixed at the developer-storing part 117 by a fixing bracket 107*a* so that a top edge thereof rounded to have a radius R of about 0.1 mm can be in contact with the developing roller 105 at the upper stream in the rotation direction thereof.

The developer layer-regulating member 107 regulates a thickness and an amount of the developer to be formed on the surface of the developing roller 105, and to frictionally electrify the developer 108 to impart a predetermined electric charge thereto by moving relative to the developing roller 105.

The developer-supplying system 100 includes a developer-supplying roller 106 supplying the developer 108 onto the developing roller 105 and removing residual developer 108 which is not transferred onto the photosensitive body 101, but remains on a surface in a non-developing region of the developing roller 105 after developing, and a residual developer-withdrawing member 110 disposed to have a predetermined gap d' from and opposite to the developer-supplying roller 106 to withdraw the residual developer 108 removed from the developing roller 105 by the developer-supplying roller 106 and transferred onto the developer-supplying roller 106.

The developer-supplying roller 106 includes a shaft of conductive metal material such as stainless steel, etc., and a roller of foam rubber material such as urethane, silicon, etc. formed outside the shaft, and is installed to come in contact with the developing roller 105 in the vicinity of the top edge of the developer layer-regulating member 107 positioned at the upper stream in the rotation direction of the developing roller 105.

The developer-supplying roller 106 rotates in a same direction (arrow B) as the developing roller 105, i.e., counterclockwise.

Also, the developer-supplying roller 106 is connected to a developer-supplying bias power source 113 to apply a developer-supplying bias voltage V2 of a same polarity as the development bias voltage V1, i.e., negative (–) polarity thereto when the developer 108 is supplied onto the developing roller 105. The developer-supplying bias voltage V2 is a bias voltage in which DC voltage greater by as much as 50–200V in absolute value than the development bias voltage V1 and AC voltage are added to each other.

Accordingly, in developer-supplying, the developer-supplying roller 106 can supply the developer 108 of negative (–) polarity onto the developing roller 105 due to an electric force generated by an electric potential difference between the development bias voltage V1 of negative (–) polarity applied to the developing roller 105 and the developer-supplying bias voltage V2 of negative (–) polarity applied to the developer-supplying roller 106, and after developing, attach and withdraw the residual developer 108, which is not transferred onto the photosensitive body 101, but remains on the surface in the non-developing region of the developing roller 105, from the developing roller 105.

The residual developer-withdrawing member 110 includes a roller part 115 disposed to leave the predetermined gap d' from and opposite to the developer-supplying roller 106, and a withdrawal-electric field generating part 116 generating a residual developer-withdrawing electric field between the developer-supplying roller 106 and the roller part 115 to transfer and attach the residual developer 108 onto the roller part 115.

Since the roller part 115 is disposed to leave the predetermined gap d' from the developer-supplying roller 106, the developer-supplying roller 106 and the roller part 115 do not directly impart stress to the residual developer 108, thereby to prevent deterioration thereof.

The roller part 115 is formed of a roller of rubber material such as urethane, silicon, etc., a sleeve of metal material such as stainless steel, aluminum, etc., or a roller of metal material such as stainless steel, aluminum, etc., and rotates in a same direction (arrow B) as the developer-supplying roller 106.

Also, the withdrawal-electric field generating part 116 includes a ground 116*a* to ground the roller part 115 to form the residual developer-withdrawing electric field between the roller part 115 and the developer-supplying roller 106 to which the developer-supplying bias voltage V2 is applied.

Alternatively, the withdrawal-electric field generating part 116 can include a withdrawal-bias power source (not shown) to apply a withdrawal-bias voltage to the roller part 115, instead of the ground 116*a*. The withdrawal-bias voltage is a bias voltage in which AC voltage and DC voltage are piled up one on another.

After being withdrawn from the developing roller 105 and attached onto the developer-supplying roller 106, the residual developer 108 is moved and attached onto the roller part 115 by an electric field difference between the roller part 115 and the developer-supplying roller 106.

The developer-supplying system 100 further includes a developer anti-incoming member 130 preventing the new developer 108 from coming into a residual developer-withdrawing region 131 of the developer-storing part 117 in which the roller part 115 of the residual developer-withdrawing member 110 is disposed to leave the predetermined gap d' from the developer-supplying roller 106, and a cleaning member 120 disposed at the developer anti-incoming member 130 to come in contact with the roller part 115 to withdraw the residual developer 108 removed from the developer-supplying roller 106 and transferred onto the roller part 115, and sent to the developer-storing part 117.

The developer anti-incoming member 130 includes a partition disposed in the developer-storing part 117 over the residual developer-withdrawing region 131 to prevent the developer 108 from coming into the residual developer-withdrawing region 131. The partition defines the residual developer-withdrawing region 131.

The partition forms a residual developer-withdrawing passage including the residual developer-withdrawing region 131 and receiving and surrounding the residual developer-withdrawing member 110 and a portion of the developer-supplying roller 106, together with a bottom of the housing forming the developer-storing part 117.

The cleaning member 120 includes a cleaning blade disposed at the anti-incoming member 130 to remove the residual developer 106 removed from the developer-supplying roller 108 and transferred onto the roller part 115, and sent to the developer-storing part 117.

The cleaning blade, which is formed of rubber material such as urethane, silicon, etc., is constructed so that a top end thereof comes in contact with the roller part 115 at the upper stream in the rotation direction thereof.

Accordingly, the cleaning blade functions to prevent the developer 108 from coming into an upper side inlet of the gap d' between the roller part 115 of the residual developer-withdrawing member 110 and the developer-supplying roller 106, as well as to remove the residual developer 108 removed from the developer-supplying roller 106 and transferred onto the roller part 115, and sent to the developer storing part 117.

The operation of the developer-supplying system 100 of the image forming apparatus of the embodiment of the present invention will now be explained with reference to FIG. 2.

First, when the developing unit 104 is operated, the one component nonmagnetic developer 108 of, for example, negative (−) polarity is moved into a nip between the developing roller 105 and the developer-supplying roller 106 by the elastic seats 114*a* of the agitator 109 rotating in the direction of arrow B, i.e., counterclockwise.

At this time, since the developer-supplying roller 106 is connected to the developer-supplying bias power source 113 to apply the developer-supplying bias voltage V2 of negative (−) polarity having DC voltage greater by as much as 50–200V in absolute value than that of the development bias voltage V1 of negative (−) polarity applied to the developing roller 105, the developer 108 of negative (−) polarity is moved onto the developing roller 105 by the developer-supplying supplying bias voltage V2 and attached thereto.

The developer 108 attached on the surface of the developing roller 105 is electrified to a predetermined electric charge, and at the same time is made in a thin developer layer having a uniform thickness, by the developer layer-regulating member 107.

Thereafter, as the developing roller 105 is rotated counterclockwise, the developer 108 of negative (−) polarity is moved into a development region in which the photosensitive body 101 faces the developing roller 105, and attached to an electrostatic latent image having a relatively positive (+) potential as compared with the negative (−) electric potential electrified on the surface of the photosensitive body 101 to form a visible image.

At this time, since the developing roller 105 continues to rotate counterclockwise, the residual developer 108, which is not transferred onto the photosensitive body 101, but remains on the surface in the non-developing region of the developing roller 105, again comes in contact with the developer-supplying roller 106 rotating in the same direction as the developing roller 105, i.e., counterclockwise across from the developing roller 105.

Accordingly, the residual developer 108 remaining on the surface in the non-developing region of the developing roller 105 is reset at a nip between the developing roller 105 and the developer-supplying roller 106. As a result, a portion of the residual developer 108 falls down into a lower space between the developing roller 105 and the developer-supplying roller 106, and the remaining developer is attached onto the surface of the developer-supplying roller 106 and moved toward the roller part 115 of the residual developer-withdrawing member 110, which is rotated in the same direction as the developer-supplying roller 106, i.e., counterclockwise, while leaving the predetermined gap d' from the developer-supplying roller 106 at the upper stream in the rotation direction of the developer-supplying roller 106.

After arriving at the roller part 115, the latter residual developer 108 attached on the surface of the developer-supplying roller 106 is moved to the roller part 115 from the developer-supplying roller 106, and is attached on the roller part 115, by the electric field difference between the grounded roller part 115 and the developer-supplying roller 106, to which the developer-supplying bias voltage V2 is applied.

Also, the former residual developer 108 fallen down into the lower space between the developing roller 105 and the developer-supplying roller 106 piles up in a space between the developer-supplying roller 106 and a bottom of the developer-storing part 117. This pile is moved into a space between the roller part 115 and the bottom of the developer-storing part 117 by a rotation force generated when the developer-supplying roller 106 is rotated counterclockwise, and is attached onto the roller part 115.

Thus, the residual developer 108 attached onto the roller part 115 of the residual developer-withdrawing member 110 is removed from the roller part 115 by the developer cleaning member 120 as the roller part 115 continues to rotate counterclockwise, and is withdrawn into the developer-storing part 117.

As a result, the roller part 115 from which the residual developer 108 is removed is maintained in a reset state that can again withdraw the residual developer 108 from the developer-supplying roller 106. Accordingly, the problem of lowered developer-supplying efficiency and residual developer-withdrawal efficiency of the developer-supplying roller 106 due to the residual developer 108 accumulated on the developer-supplying roller 106 can be prevented. Also, a problem of lowered density of the resultant image by unevenly electrifying the developer layer when it is regulated by the developer layer-regulating member 107 can be prevented.

Next, the residual developer 108 withdrawn into the developer-storing part 117 is mixed with the new developer 108 by the elastic seats 114*a* of the agitator 109, and is then moved into the nip between the developing roller 105 and the developer-supplying roller 106 to repeat the operation described above.

On the other hand, as the photosensitive body 101 is rotated in the direction of arrow A, i.e., clockwise, the developer 108 in the form of the visible image attached to the electrostatic latent image on the photosensitive body 101 is transferred onto a sheet of paper supplied between the photosensitive body 101 and a transfer roller (not shown) disposed therebelow, and after the developer 108 transferred on the sheet of paper is fixed through the fixing unit (not shown), the sheet of paper is discharged to the outside by the discharging unit (not shown), in a similar manner as the conventional image forming apparatus shown in FIG. 1.

As is apparent from the foregoing description, it can be appreciated that in accordance with the embodiment of the present invention, the developer-supplying system of the image forming apparatus has the residual developer-withdrawing member to withdraw the residual developer removed from the developing roller by the developer-supplying roller and transferred onto the developer-supplying roller, thereby preventing the developer-supplying efficiency and the residual developer-withdrawal efficiency of the developer-supplying roller from being reduced, and reducing stress to the developer to prevent the developer from deteriorating.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A developer-supplying system for use in an image forming apparatus having a developer-storing part to store a developer, a photosensitive body to form a latent image, and a developer transfer body rotated to face the photosensitive body, to transfer the developer from the developer-storing part to the photosensitive body to form a visible image according to the latent image, comprising:

a developer-supplying member supplying the developer onto the developer transfer body and removing the residual developer which is not transferred onto the photosensitive body; and a residual developer-withdrawing member disposed in a spaced-apart relation with and opposite to the developer-supplying member to withdraw the residual developer from the developer-supplying member.

2. The system according to claim 1, wherein the residual developer-withdrawing member comprises:

a roller part disposed in a spaced-apart relation with and opposite to the developer-supplying member; and a withdrawal-electric field generating part generating a residual developer-withdrawing electric field between the developer-supplying member and the roller part to transfer the residual developer onto the roller part.

3. The system according to claim 2, wherein the roller part comprises a roller formed of a rubber material, or a sleeve formed of a metal material, or a roller formed of a metal material.

4. The system according to claim 2, wherein the roller part rotates in a same direction as a direction of rotation of the developer-supplying member.

5. The system according to claim 2, wherein the withdrawal-electric field generating part comprises a ground to ground the roller part to form the residual developer-withdrawing electric field between the developer-supplying member and the roller part.

6. The system according to claim 2, wherein the withdrawal-electric field generating part comprises a withdrawal-bias power source connected to the roller part, to apply a withdrawal-bias voltage thereto to form the residual developer-withdrawing electric field between the developer-supplying member and the roller part.

7. The system according to claim 2, further comprising:

a developer anti-incoming member preventing the developer from entering into a residual developer-withdrawing region of the developer-storing part in which the roller part of the residual developer-withdrawing member is disposed in a spaced-apart relation with the developer-supplying member; and a cleaning member disposed at the developer anti-incoming member to contact the roller part to withdraw the residual developer from the developer-supplying member.

8. The system according to claim 7, wherein the developer anti-incoming member comprises a partition disposed in the developer-storing part over the residual developer-withdrawing region to prevent the developer from entering into the residual developer-withdrawing region, and defining the residual developer-withdrawing region.

9. The system according to claim 8, wherein the cleaning member comprises a blade formed of a rubber material, and fixed at the partition to allow a top end thereof to contact the roller part.

10. The system according to claim 9, wherein the developer transfer body comprises a sleeve formed of a nonmagnetic material or a roller formed of a rubber material, wherein the developer-supplying member includes a roller formed of a foam rubber material.

11. An apparatus comprising:

a supplier to receive a developer and supply the developer to develop an electrostatic image; and a withdrawing member spaced apart from the supplier to withdraw the developer not used to develop the electrostatic image from the supplier.

12. The apparatus according to claim 11, further comprising:

a developing unit to receive the developer from the supplier; and a photosensitive body having the electrostatic image thereon to receive the developer from the developing unit, wherein the supplier receives the developer not used to develop the electrostatic image from the developing unit.

13. The apparatus according to claim 11, wherein the withdrawing member withdraws the developer remaining on the supplier after the electrostatic image is developed.

14. The apparatus according to claim 11, wherein the withdrawing member is spaced apart from the supplier by a predetermined gap.

15. The apparatus according to claim 11, further comprising an agitator to supply the developer to the supplier.

16. The apparatus according to claim 15, further comprising a housing to contain the developer.

17. The apparatus according to claim 16, wherein the agitator comprises:

a rotating wing; and an elastic seat attached to the wing to contact an inner surface of the housing.

18. The apparatus according to claim 12, wherein the withdrawing member comprises:

a roller to form a gap with the supplier; and a field generating part to generate an electric field to attach the developer not used to develop the electrostatic image to the roller.

19. The apparatus according to claim 18, wherein the field generating part comprises a ground.

20. The apparatus according to claim 19, wherein a bias voltage is applied to the supplier, and the ground forms the electric field.

21. The apparatus according to claim 18, wherein the field generating part comprises a withdrawal bias power source to supply a withdrawal bias voltage to the roller.

22. The apparatus according to claim 21, wherein a bias voltage is applied to the supplier, and the withdrawal bias voltage forms the electric field.

23. An image forming device comprising:

a photosensitive unit to form a latent image thereon;

a developing unit to develop the latent image with a developer; and a supply unit comprising:

a supplier to supply the developer to the developing unit and remove the developer from the developing unit that is not used to develop the latent image, and a withdrawing member spaced apart from the supplier to withdraw the developer not used to develop the latent image from the supplier.

24. An apparatus comprising:

a supplier to receive a developer and supply the developer to develop an electrostatic image; and a withdrawing member to withdraw the developer not used to develop the electrostatic image from the supplier, the withdrawing member not directly imparting a stress to the unused developer.

* * * * *